US005689992A

United States Patent [19]

Saunders et al.

[11] Patent Number: 5,689,992

[45] Date of Patent: *Nov. 25, 1997

[54] DRAW-PROCESSING OF CAN BODIES FOR SANITARY CAN PACKS

[75] Inventors: William T. Saunders, deceased, late of Weirton, by Cleo Saunders, executrix; William H. Dalrymple, Weirton, both of W. Va.

[73] Assignee: Weirton Steel Corporation, Weirton, W. Va.

[ * ] Notice: The portion of the term of this patent subsequent to May 14, 2008, has been disclaimed.

[21] Appl. No.: 753,266

[22] Filed: Nov. 22, 1996

Related U.S. Application Data

[63] Continuation of Ser. No. 155,511, Nov. 22, 1993, Pat. No. 5,590,558, which is a continuation-in-part of Ser. No. 596,854, Oct. 12, 1990, Pat. No. 5,343,729, and a continuation-in-part of Ser. No. 866,661, Apr. 8, 1992, Pat. No. 5,409,130, and a continuation-in-part of Ser. No. 14,263, Feb. 5, 1993, Pat. No. 5,263,354, and a continuation-in-part of Ser. No. 53,458, Apr. 27, 1993, Pat. No. 5,347,839, said Ser. No. 866,661, is a division of Ser. No. 573,548, Aug. 27, 1990, Pat. No. 5,119,657, said Ser. No. 14,263, is a division of Ser. No. 831,624, Feb. 21, 1986, Pat. No. 5,014,536, which is a continuation of Ser. No. 712,238, Mar. 15, 1985, abandoned, said Ser. No. 53,458, is a division of Ser. No. 490,781, Mar. 8, 1990, Pat. No. 5,209,099.

[51] Int. Cl.[6] ..... B21D 22/22

[52] U.S. Cl. ..... 72/347

[58] Field of Search ..... 72/329, 346, 347, 72/348, 349, 350

[56] References Cited

U.S. PATENT DOCUMENTS

| | | | |
|---|---|---|---|
| 3,494,169 | 2/1970 | Saunders | 72/350 |
| 3,704,618 | 12/1972 | Cvacho et al. | 72/350 |
| 4,036,056 | 7/1977 | Saunders | 72/329 |
| 4,414,836 | 11/1983 | Saunders | 72/348 |
| 4,425,778 | 1/1984 | Franek et al. | 72/347 |
| 4,584,859 | 4/1986 | Saunders | 72/349 |
| 4,711,611 | 12/1987 | Bachmann et al. | 72/347 |
| 4,863,333 | 9/1989 | Kaminski | 72/349 |
| 4,976,131 | 12/1990 | Grims et al. | 72/347 |
| 5,014,536 | 5/1991 | Saunders | 72/349 |
| 5,119,657 | 6/1992 | Saunders | 72/349 |
| 5,343,729 | 9/1994 | Saunders | 72/349 |
| 5,347,839 | 9/1994 | Saunders | 72/349 |

*Primary Examiner*—Lowell A. Larson
*Attorney, Agent, or Firm*—Shanley and Baker

[57] ABSTRACT

Draw processing flat-rolled sheet metal substrate preselectively precoated on each surface with organic coating and draw lubricant into one-piece can bodies ready for assembly into sanitary can packs free of any requirement for applying organic coating or adding organic coating for repair purposes after fabrication and before such direct usage. Cupping of precoated flat-rolled sheet metal can stock using preselected tooling configurations and clearance avoids any increase in side wall metal thickness gage. Tension elongation during redraw is controlled over side wall height by clamping solely between planar clamping surfaces, tooling configurations and preselected clearances to decrease thickness gage uniformly over side wall height between flange metal open end of can body and curved transition zone at closed end. High production rate blanking and cupping is achieved with out-of-phase simultaneous movement of cupping die and punch which provides for rapid discharge cup-shaped work product, open-end-down on flange at open end of cup. Surface area of the cavity entrance zone for each die is fabricated about multiple radii forming sharp edge about which coated can stock is drawn into each die cavity. Curved surface transition zone for each punch is maintained large in relation to sheet metal substrate starting gage which facilitates change of configuration of metal from planar state into cylindrical side wall.

4 Claims, 9 Drawing Sheets

FIG. 8
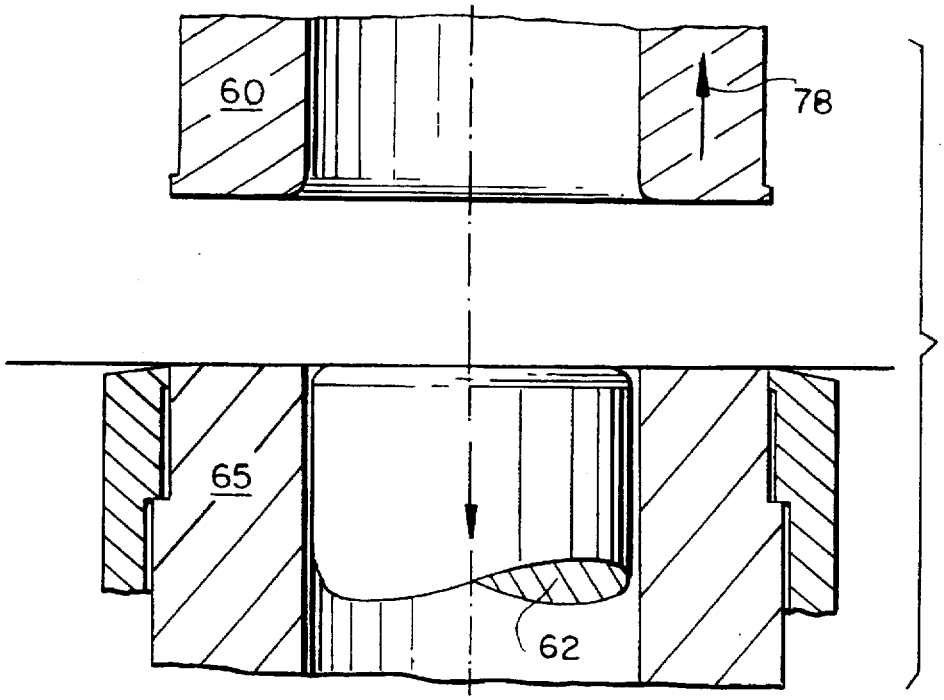
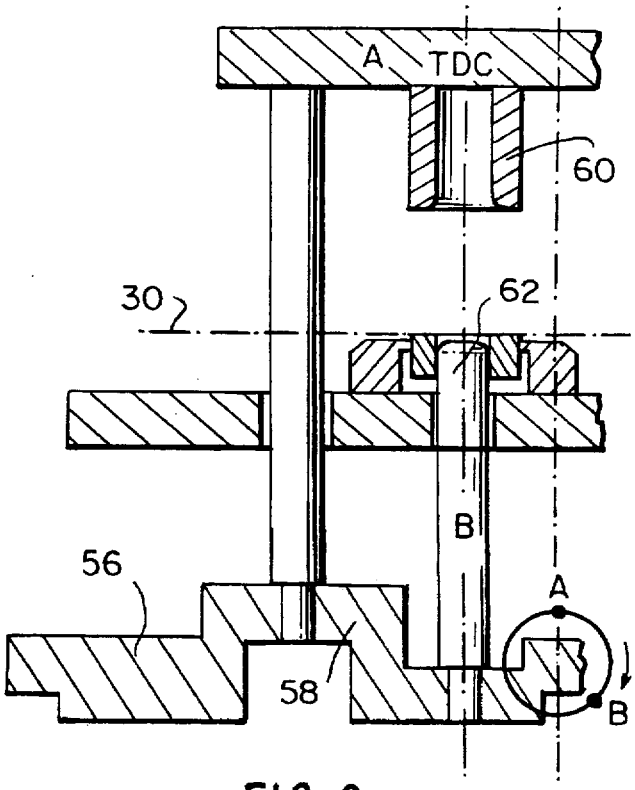
FIG. 9
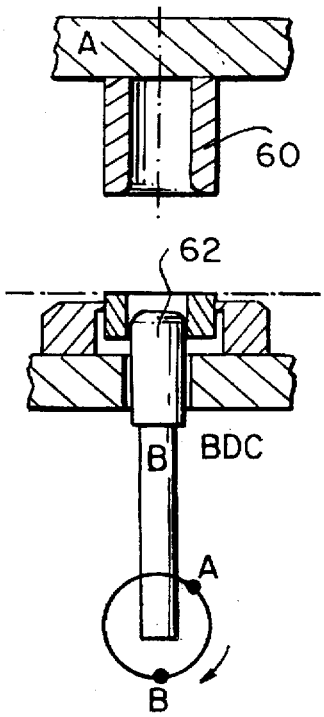
FIG. 10

DRAW-PROCESSING OF CAN BODIES FOR SANITARY CAN PACKS

RELATED APPLICATIONS

This application is a continuation of application Ser. No. 08/155,511, now U.S. Pat. No. 5,590,558, entitled DRAW-PROCESSING OF CAN BODIES FOR SANITARY CAN PACKS, filed Nov. 22, 1996, which is a continuation-in-part of co-owned applications:

U.S. application Ser. No. 07/596,854 entitled FABRICATING ONE-PIECE CAN BODIES WITH CONTROLLED SIDE WALL ELONGATION, filed Oct, 12, 1990, now U.S. Pat. No. 5,343,729 granted Sep. 6, 1994;

U.S. application Ser. No. 07/866,661 now U.S. Pat. No. 5,409,130 granted Apr. 25, 1995 entitled ONE-PIECE DRAW PROCESS CAN BODIES, filed Apr. 8, 1992 as a division of U.S. application Ser. No. 07/573,548, filed Aug. 27, 1990, now U.S. Pat. No. 5,119,657 granted Jun. 9, 1992;

U.S. application Ser. No. 08/014,263, now U.S. Pat. No. 5,263,354 granted Nov. 23, 1993, entitled DRAWN CAN BODY METHODS, APPARATUS AND PRODUCTS, filed Feb. 5, 1993 as a division of U.S. application Ser. No. 06/831,624 entitled METHOD AND APPARATUS FOR DRAWING SHEET METAL CAN STOCK (as amended), filed Feb. 21, 1986, now U.S. Pat. No. 5,014,536 granted May 14, 1991, which was a continuation-in-part of U.S. application Ser. No. 06/712,238 entitled DRAWN CAN BODY METHODS, APPARATUS AND PRODUCTS, filed on Mar. 15, 1985 (now abandoned); and U.S. application Ser. No. 08/053,458, now U.S. Pat. No. 5,347,839 granted Sep. 20, 1994, entitled DRAW-PROCESS METHODS, SYSTEMS AND TOOLING FOR FABRICATING ONE-PIECE CAN BODIES, filed Apr. 27, 1993 as a division of U.S. application Ser. No. 07/490,781 entitled DRAW-PROCESS METHODS, SYSTEMS AND TOOLING FOR FABRICATING ONE-PIECE CAN BODIES, filed Mar. 8, 1990, now U.S. Pat. No. 5,209,099.

This invention relates to new draw-process fabricating methods and apparatus for improved production of new sanitary-pack can bodies from can stock comprising flat-rolled sheet metal substrate precoated with organic coating and draw lubricant. In particular, this invention is concerned with draw-processing substantially-uniform side wall thickness can bodies for sanitary can packs from such can stock free of any side wall ironing step.

A contribution of the new draw-processing teachings being presented is the capability of maintaining the integrity of the organic polymeric coating, as precoated on flat-rolled sheet metal, during shaping of a cup-shaped work product and reshaping into cylindrical configuration one-piece can bodies. The draw-processing fabrication is isolated from the flat sheet metal coating and treatment processing; the draw-processed can bodies do not require treatment during processing and are ready as fabricated for use in sanitary can packs for comestibles without application of organic coating or adding of any organic coating for coating repair purposes.

A significant commercial contribution is the decrease in sheet metal costs for sanitary-pack can bodies. The prior art conventional draw-redraw practice increases side wall metal thickness above strength requirements for sanitary can packs. In that conventional draw-redraw practice, thickening of the side wall increases progressively in approaching the open end of a one-piece sheet metal can body. And, when side wall ironing is resorted to in an attempt to overcome that side wall thickening problem, heavier gage starting material must be used from the start of the drawing and ironing process. As a result, the gage of the bottom wall metal in the drawn and ironed can body can significantly exceed that normally required for sanitary can pack strength purposes, and organic coating facilities have been required after drawing and ironing.

Present teachings significantly decrease sheet metal costs by decreasing blank cut edge diameter requirements in relation to conventional draw-redraw requirements; and, also, enable more uniform gage decrease of side wall metal during draw-processing fabrication of precoated can stock.

The can body of the invention is fabricated with flange metal at its open end from lighter-weight precoated can stock which is able to meet sanitary pack strength requirements, and is ready for sanitary can packs as fabricated eliminating post-fabrication organic coating or organic coating repair facilities. Precoated work-hardened flat-rolled steel is a preferred embodiment for economically achieving the above objective.

For purposes of more detailed description of new blanking and cupping press means, specific embodiments of new draw-processing steps with improved, more uniform side wall tension control and new one-piece can bodies for sanitary can packs, reference is made to the accompanying drawings, in which:

FIGS. 2–8 are schematic cross-sectional partial views of blanking and cupping and tooling with locations at selected sequential cycle times for describing blanking and cupping methods and offset relative movement of tooling in accordance with the invention;

Figure 24:
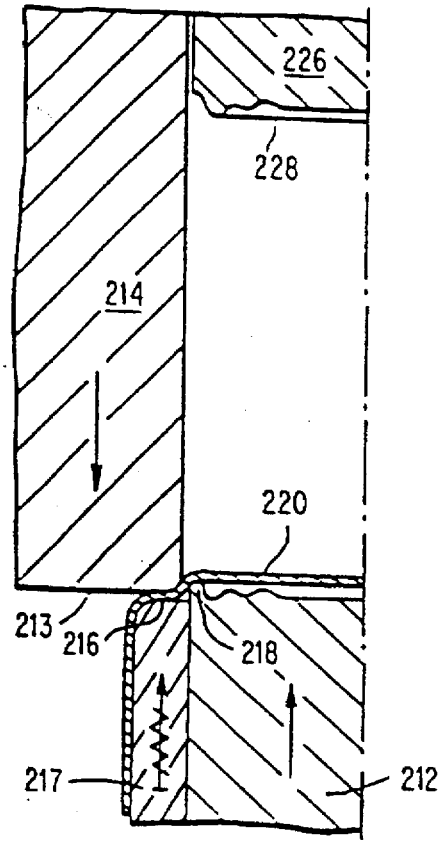
Figure 25:
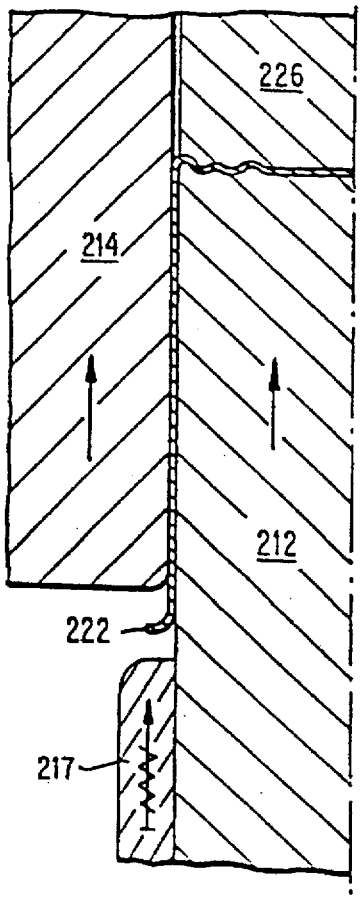
Figure 20:
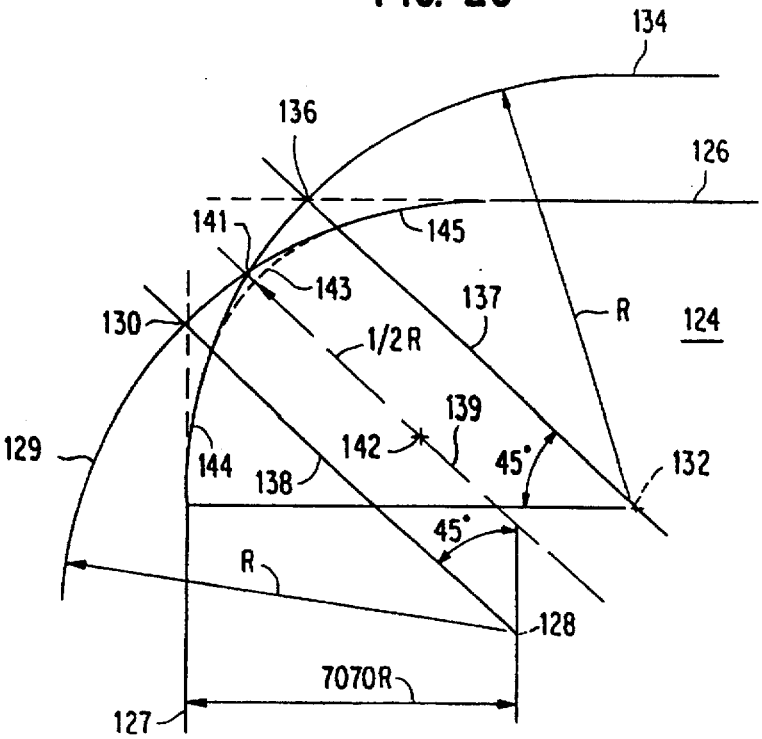
Figure 21:
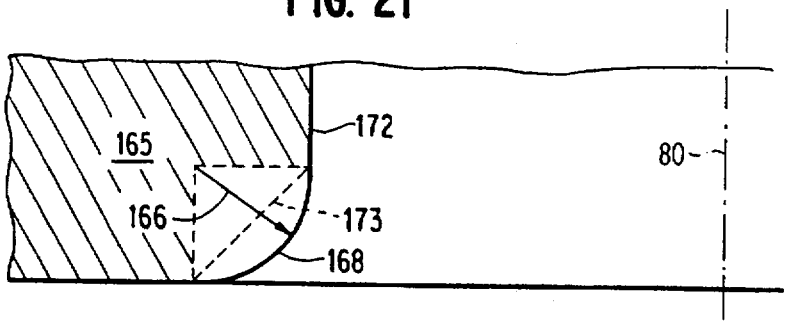
Figure 22:
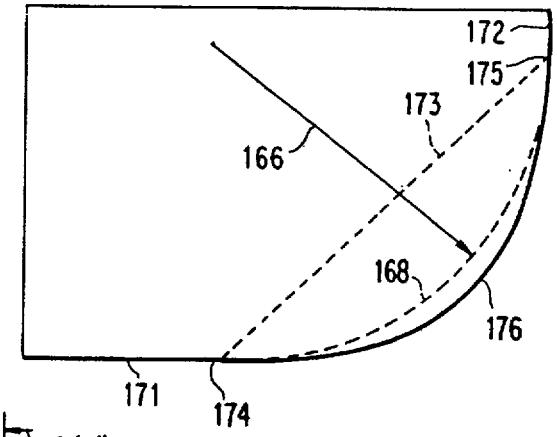
Figure 23:
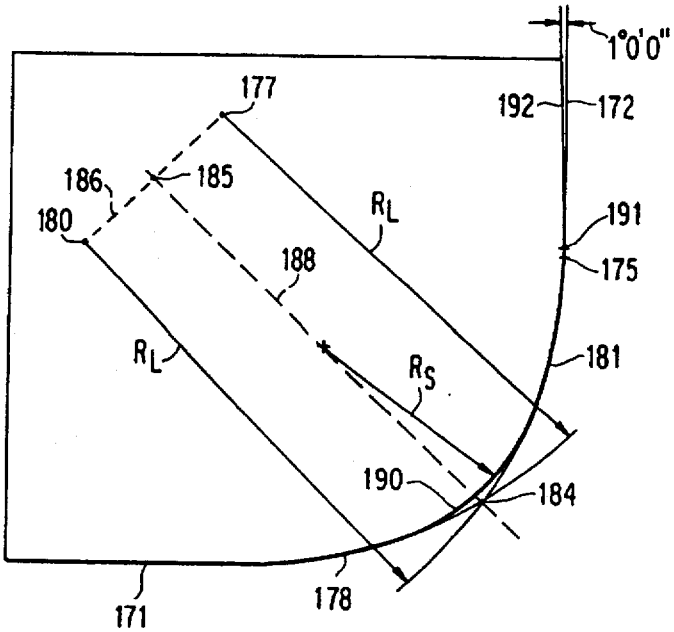

FIGS. 9–13 present a schematic arrangement of interrelated partial views of cupping press means for describing rotary (360°) crankshaft operation with separate connector arm means for providing out-of-phase relative movement of separate drive means for the cupping die and separate drive means for the cupping punch, in accordance with the invention;

FIGS. 14–19 are enlarged cross-sectional partial views for describing reshaping, in preparation for redraw, of the curved-surface unitary juncture between endwall and side wall of the drawn cup-shaped work product of FIGS. 2–8;

FIG. 20 is a presentation for describing the geometry in manufacture of the multiple-radius curved-surface transition zone between a planar clamping surface and cylindrical side wall shown in FIGS. 11–14;

FIGS. 21–23 are schematic, cross-sectional partial views for describing another embodiment of a multiple-radius curved-surface transition zone as used between a near cylindrical internal wall of die cavity and the planar clamping surface circumscribing such entrance zone for a cupping die, or for a redraw die of the invention and;

FIGS. 24–25 are cross-sectional partial views of endwall profiling tooling and the can body with final redraw endwall profiling.

In accordance with the invention, planar can stock comprising flat-rolled sheet metal precoated with organic polymeric coating and draw-processing lubricant is shaped into a cup-shaped work product with flange metal at its open end. The cup-shaped shallow-depth work product is then reshaped by draw-processing into a precoated cylindrical-configuration one-piece can body. Precoated flat-rolled sheet metal from a cut planar blank is shaped into the cup shape with endwall, side wall, and flange metal at the open end of the one-piece work product. A small diameter one-piece can body is then formed, adding height substantially uniformly decreasing side wall thickness under tension, while maintaining an upper end flange.

In draw-processing to form cylindrical one-piece can bodies, planar metal is converted into curvilinear side wall metal and draw-processing always involves a decrease in diameter in order to form or increase side wall height. However, cold-forging side wall metal of a cup-shaped work product in order to increase side wall height involves working of only side wall metal, a process step referred to as side wall ironing in the canmaking industry. Such an ironing step does not involve conversion of planar metal into curvilinear side wall metal; nor does it change the container diameter.

Fabricating one-piece can bodies by prior art draw-redraw practice increases the thickness gage of the side wall metal in approaching the open end of the can body as the flat-rolled metal is reshaped into a cylindrical cup. The present invention eliminates such thickening of side wall metal by improved tooling configuration and clamping practice. The side wall metal of the drawn cup is then decreased uniformly by improved tension control during draw and redraw-processing of can bodies with flange metal for use in cylindrical sanitary can packs. In two-step processing of the invention, can body diameter exceeds can body side wall height; and a three-step process produces can bodies for sanitary can packs, for example condensed soup cans, where side wall height can exceed can body diameter.

Figure 1:
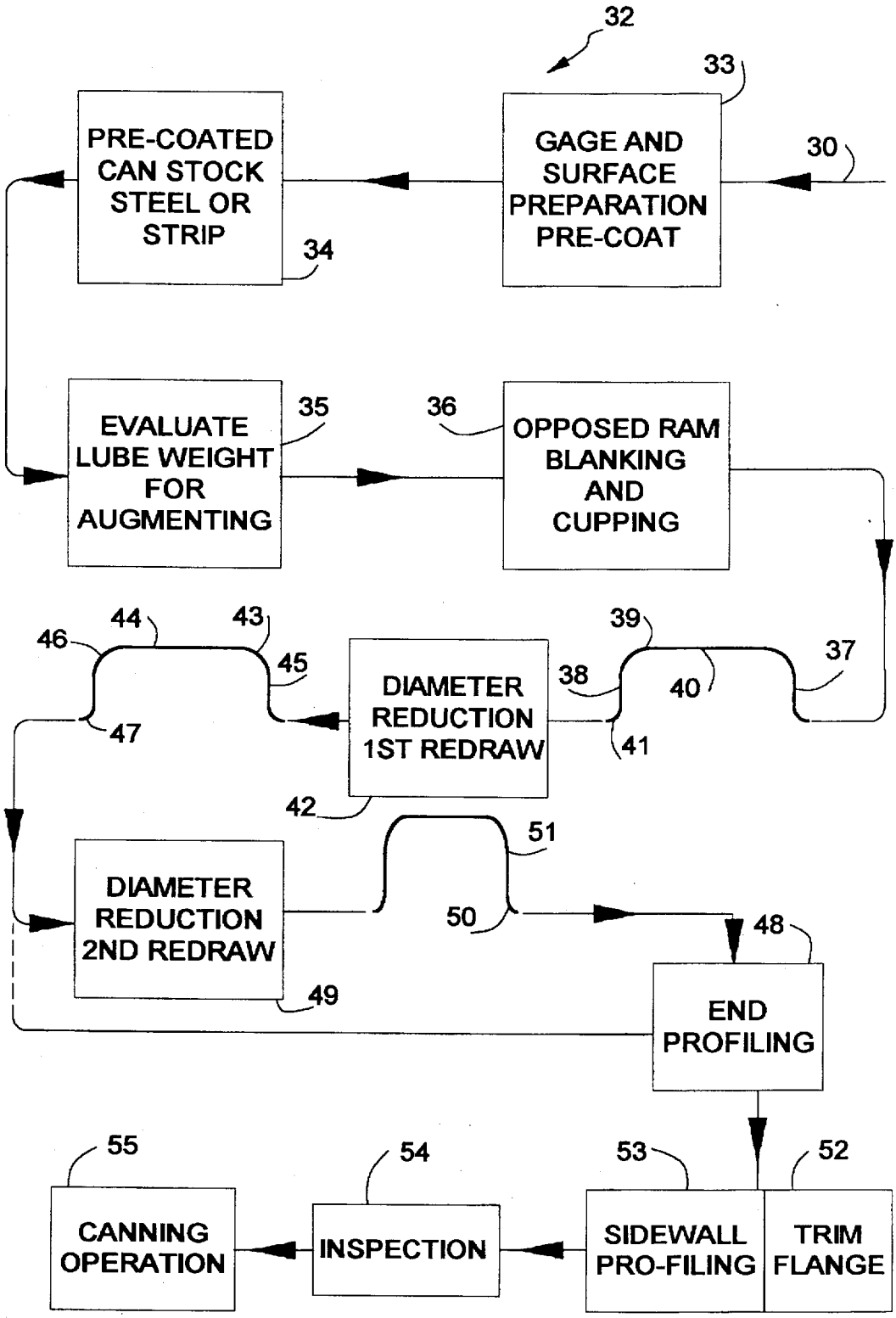
FIG. 1 is a diagrammatic general-arrangement presentation for describing specific draw-processing steps and sequencing of the invention for improved in-line fabrication of new precoated one-piece can bodies.

Referring to the general arrangement diagrammatic presentation of FIG. 1, a travel path 30 is established at the entrance to fabrication line 32 for precoated can stock. Flat-rolled sheet metal is prepared to predetermined gage and surface preparation at station 33 and precoated with organic polymeric coating and draw lubricant at station 34. Determining adequacy of lubrication and whether augmenting by surface lubrication is required is carried out at station 35.

The invention avoids thickening of side wall substrate during forming of a cup-shaped work product. And, as the work product diameter is decreased in a single redraw operation or double redraw operations, an improved tension control is exercised in the side wall to provide uniform substrate thickness gage throughout side wall height between a closed endwall juncture and open-end flange metal. Solely planar clamping contributes to uniform control of side wall tension throughout the new draw-processing steps; and the entire process of the invention is entirely free of any ironing step.

Improved metal economy for draw-processed organic polymeric-coated can bodies is a commercially significant contribution as is sheet metal preparation (33) and precoating of can stock (34) independently of the fabricating line. Draw-processing is carried out without any treatment of the can stock or can body required prior to canning.

In the blanking phase of a new blanking and cupping press means 36 (FIG. 1), a blank of preselected diameter is cut from precoated flat-rolled can stock. Then, a cup-shaped work product 37 is formed and discharged directly onto the fabricating line travel path, open-end-down.

The invention teaches that the bulk of the gross diameter reduction, that is the decrease from cut blank diameter to final can body diameter, is to be achieved during the cupping operation, which is a significant departure from prior practice. The invention enables such significant decrease in a single stroke cupping operation free of wrinkles in, or buckling of, the sheet metal can stock. At least about fifty and up to about ninety percent of that gross diameter-reduction, from cut blank diameter to final can body diameter, is accomplished during the cupping portion of the blanking and cupping operation of the present invention.

Commercial blanking and cupping operations in the past have tended to slow operations in single action presses, or have required special handling of the cup-shaped work product for subsequent processing. One aspect of the invention is specifically concerned with decreasing stroke time by providing relative movement between cupping die and cupping punch during the cupping operation. The cupping operation (FIGS. 2–13) also avoids product drive-through and avoids any need to invert, or otherwise handle, the drawn cup prior to subsequent processing. Part of increasing production rate is accomplished by increasing rate of movement of the tooling after cup formation. Also, the drawn cup-shaped work product 37 is discharged directly onto the travel path of the fabricating line on its flange open-end-down as forming of cup 37 (FIG. 1) is completed. The cup-shaped work product 37, with side wall metal 38 between transition zone 39 at endwall 40 and flange metal 41 at its open end, travels open-end-down on flange metal 41 in the fabricating line travel path toward redraw station 42. Open-end-down fabrication continues in a single redraw press to produce shallow-depth can body 43, having an endwall 44 and side wall 45 extending between transition zone 46 and open end flange 47.

Side wall thickness gage is prevented from increasing in the cupping operation. And in subsequent redraw operations, side wall thickness gage is decreased as a new container diameter is fabricated. Improved tension control for uniform tension elongation is provided as the new diameter is formed. That is, side wall height is increased while uniformly decreasing side wall thickness gage by controlled tension elongation, using method and means described later in more detail.

Flat-rolled sheet metal of predetermined gage (and preferably of work-hardened characteristics) is produced at station 33 and precoated on both its surfaces with organic polymeric coating and lubricant. Such preparation and coating are preferably carried out on continuous strip; but cut sheet metal can be precoated and fed into new blanking and cupping press means 36. Can bodies are ready as draw-processed for direct use in canning comestibles without requirement for lubricant removal, cleansing-type treatment, organic coating, or adding of organic coating to the precoat. Can body finishing, as part of a fabricating line, includes endwall profiling (indicated schematically at 48). In practice of the invention, endwall profiling is carried out as part of the two-step process at redraw press 42, or as part of a three-step process at second diameter reduction redraw station 49. That is, in production each final redraw press includes endwall profiling structure as an integral part of the redraw tooling, as shown and described in more detail later.

Trimming of flange metal 47, or trimming of flange metal 50 of second redrawn can body 51, is carried out at station 52. An optional side wall profiling (for selected can bodies in which side wall height exceeds can body diameter$_{atr}$) is carried out at station 53 as flange trimming is completed. The can body is inspected at station 54, for example, for pin holes before canning at station 55.

Figure 11:
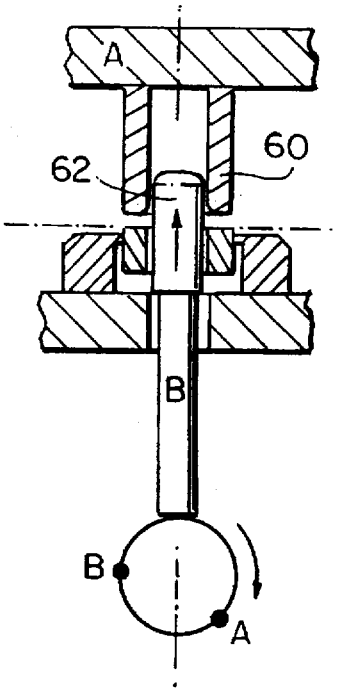
Figure 12:
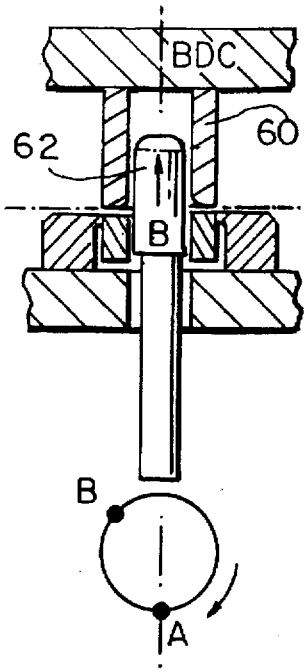
Figure 13:
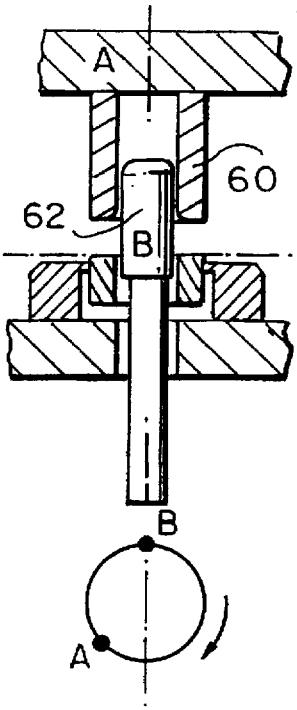

Use of the tooling means of FIGS. 2–8 in the blanking and cupping press means of FIGS. 11–13 increases the production rate for drawn sheet metal cup-shaped work product over that of previous commercial practice. Thus, operation of the overall can body fabricating line over a wider range of production rates is made practical so as to facilitate better coordination of can body fabrication with on-site canning operations.

The organic polymeric coating applied to a surface-prepared sheet metal substrate embodies a "blooming compound"; that is, a lubricant which is activated by the heat and/or pressure of draw-processing fabrication. Pre-measurement of lube coating weight (blooming compound and added surface coating) is evaluated at station 35 for possible augmenting of lubricant by surface application to the can stock while in planar form. The precoated organic coating and draw lubricant (integral blooming compound and/or surface applied) are preselected, in particular for the internal (product side) surfaces of can bodies for comestibles, to meet requirements of governmental regulatory agencies such as the U.S. Food and Drug Administration and/or the U.S. Department of Agriculture.

The blooming compound incorporated in the organic coating and/or surface-applied augmenting lubrication are selected for each surface. Total lubricant coating weight on each surface is preselected in the range of about 15 to 20 mg/sq. ft. Organic and lubricant requirements to meet fabricating stress on the external, or public-side, surface of the can body can differ from requirements on the internal, or product-side, surface.

Copending and co-owned U.S. patent applications Ser. No. 07/926,055 entitled COMPOSITE-COATED FLAT-ROLLED SHEET METAL MANUFACTURE AND PRODUCT, filed Aug. 6, 1992 and Ser. No. 08/047,451 entitled LIGHT-GAGE, COMPOSITE-COATED FLAT-ROLLED STEEL MANUFACTURE AND PRODUCT, filed Apr. 19, 1993 are incorporated herein by reference for further details relating to surface preparation practices for preparing flat-rolled steel as a preferred substrate for organically coated can stock. Thermosetting organic polymeric coatings and draw lubricant materials approved by the U.S. Food and Drug Administration for use in canning comestibles are set forth in copending parent application Ser. No. 07/866,661 which is incorporated herein by reference.

The flat-rolled sheet metal substrate with a single reduced substrate having a starting gage of about fifty to about eighty-five lb/bb is preferred. Work-hardened sheet metal has advantages during the draw processing by diminishing change in substrate characteristics, for example. Double-reduced flat-rolled steel (see *Making, Shaping and Treating Steel*, 9th Ed., 1971, page 971 ©AISE, printed by Herbick & Held, Pittsburgh, Pa.) is used in thickness gages of about fifty to about seventy lb/bb and/or triple-reduced work-hardened steel described in copending parent patent application Ser. No. 08/047,451 (which is included herein by reference) is used in starting gage from about thirty-six to about fifty lb/bb.

The planar portion of the closed endwall 40 of cup 37 is at starting gage. A large curved-surface area punch nose is selected for forming the curved-surface unitary juncture 39 between endwall 40 and flange 41. The curved-surface area of the cupping punch nose corresponds to the curved-surface area of transition zone 39 of the cup-shaped work product; a large surface area punch nose is preselected to facilitate initiation of sheet metal movement.

The major decrease in diameter (from blank to final can body diameter) is selected to be carried out in the blanking and cupping press. Above 50% to about 90% of the total diameter decrease, that is, from blank diameter size to the desired final can body diameter size takes place in the cupping operation.

The initiation of movement of flat-rolled sheet metal from its planar configuration into a cylindrical configuration is facilitated by the predeterminedly large curved-surface area of the punch nose. The unitary juncture 39 of drawn cup 37 is drawn about a punch nose radius having a curved surface area as large as possible while avoiding buckling of the sheet metal. The punch nose curved surface area, as projected on a horizonal clamping plane and measured radially, exceeds thirty and extends up to about forty times nominal starting thickness gage for the can stock substrate. A large surface area, with about three-tenths inch projection as measured radially, for example, is used with sixty-five lb/bb. (0.0064" to 0.0079") double reduced flat-rolled steel.

Forming the cavity entrance zone of the cupping draw die about as small a curved surface as practical, while avoiding tearing of the substrate, includes about one to about five times sheet metal gage as projected on a horizontal clamping plane. Such departures from conventional draw practice, along with preselected tooling clearance equal to can stock thickness, facilitate cup formation and eliminate any thickening of side wall metal during the cupping operation.

In a more specific teaching of the invention, the draw die curved surface entrance zone is formed about multiple radii described in part in the copending parent patent application Ser. No. 07/596,854 which is incorporated herein by reference, and is also described later herein.

As part of new blanking and cupping teachings, the cup-shaped work product 37 is formed with open-end down and travels open-end-down on flange metal 41. In the can body fabricating system of the invention, such open-end-down travel on flange metal continues throughout draw-processing. Flange metal is oriented in a plane which is transverse (at or near perpendicular) to the centrally located axis of the cup-shaped work product. The latter axis is perpendicular to the geometric center of the circular configuration endwall of the work product and during product forming is coincident with the centrally-located axis of the tooling. The flange metal around the full open end periphery is properly oriented to support the work product for travel in the fabricating line, and to prevent distortion of the cylindrical configuration at the open-end of the work product to facilitate proper feed into redraw apparatus.

Solely planar clamping enables more uniform control of tension around full perimeter during the formation of a cup, and more uniform tension elongation is achieved in redraw-processing to produce substantially uniform side wall thickness gage throughout side wall height from closed end unitary curved surface transition zone to the flange metal at the open end of the can body.

Referring to FIGS. 2–8 and FIGS. 11–13, the cupping die and cupping punch both move in relation to each other in a closing direction to form the cup; and, subsequently, both move in an opening direction in relation to each other to release and discharge the drawn cup-shaped work product, on its flange, for movement along the fabrication line travel path as new sheet metal advances into station 36 for blanking.

That is, both the draw die and draw punch move rapidly away from each other to release the cup. The total length of cup forming stroke is effectively equal to side wall height; but the actual stroke time is significantly decreased in relation to the conventional draw apparatus operation, and the can stock incoming feed time is advanced and increased.

Use of a rotary-drive crankshaft drive source, shown schematically at 56 in FIG. 9, driven, e.g., by an electric motor (not shown), and acting through connector arm means 58, enables predetermined selection of relative movement between cupping die 60 and cupping punch 62. By selection of out-of-phase (about 135°) motion for each, the timing can be more effective over a 360° cycle. The coacting cup forming stage of the cycle can be selected when the rate of movement of each tool is slower, which facilitates cup formation, and more rapid release of the formed cup takes place when each tool is moving at a faster rate. Movement of can stock into the press can be advanced to facilitate movement of the released cup from the press.

The separate connecting arm means are selected for driving the cupping die and for driving the cupping punch, which are driven by a single rotary drive crankshaft means, as shown in FIG. 9.

Figure 2:
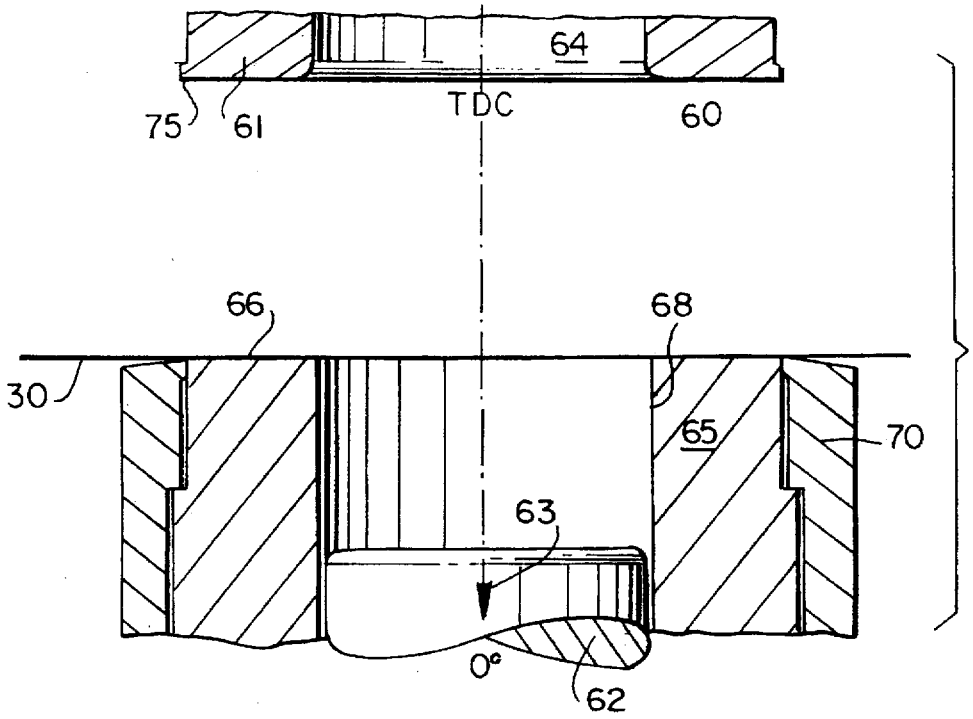

In FIG. 2, cupping die 60 is in its top dead center (TDC) position, and cupping punch 62 is moving downwardly in the direction indicated by arrow 63 away from die cavity 64. The clamping ring 65 is spring-loaded with planar clamping surface 66 in the travel path of the fabricating line; the cutting edge of blanking die 70 also is spring-loaded upwardly by clamping ring 65.

The cupping die and cupping punch, as shown in FIGS. 2–13, are driven out-of-phase (by about 135°) by the crankshaft means and connector arm means. The relative movement between the die and punch decreases the cup forming time, releases the formed cup more rapidly, and increases the production rate of the press. Fast release of the formed cup provides for early movement of can stock into the press, and rapid discharge of the cup open-end-down onto the travel path of the system.

Cupping die 60, at its top dead center (TDC) in FIG. 2, is at the start of a three hundred sixty degree cycle for rotary drive crankshaft means 56 of FIG. 9. At about 40° into that 360° cycle (FIG. 3); cupping die 60 is moving downwardly in the direction shown by arrow 73. Note that cupping punch 62, which had been moving downwardly in FIG. 2, reaches its bottom dead center (BDC) in FIG. 3. In the illustrated embodiment of the invention, the cupping die and cupping punch are moving about a hundred and fifty degrees out-of-phase.

From about 40° to about 147° (FIG. 4) into the 360° cycle of rotary drive, cupping die 60 and cupping punch 62 are moving toward each other (in a closing direction) from opposite sides of fabricating travel plane 30. Punch 62 is moving toward the can stock surface which will constitute the interior (product side) of the work product; and punch 62 is moving in the direction of arrow 74 toward the exterior or public side of the cup, and the cup is to be drawn open-end-down.

Figure 3:
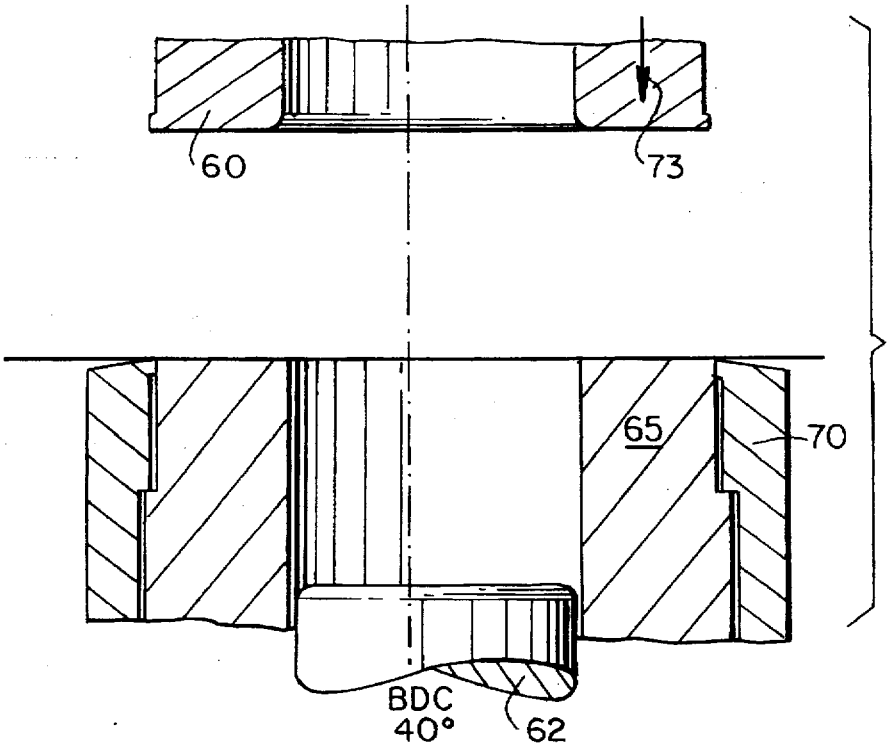
Figure 4:
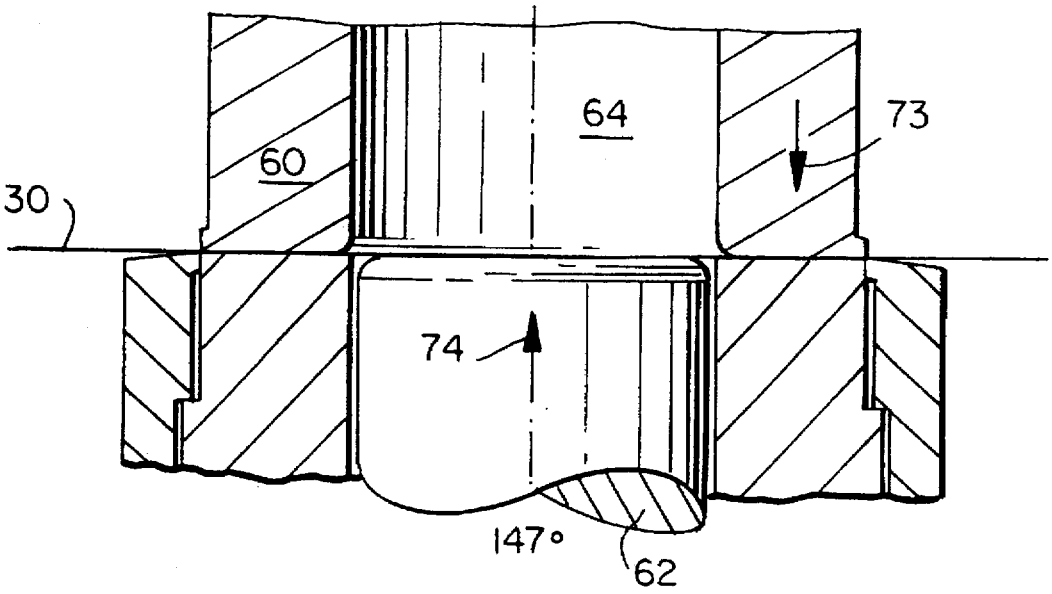
Figure 5:
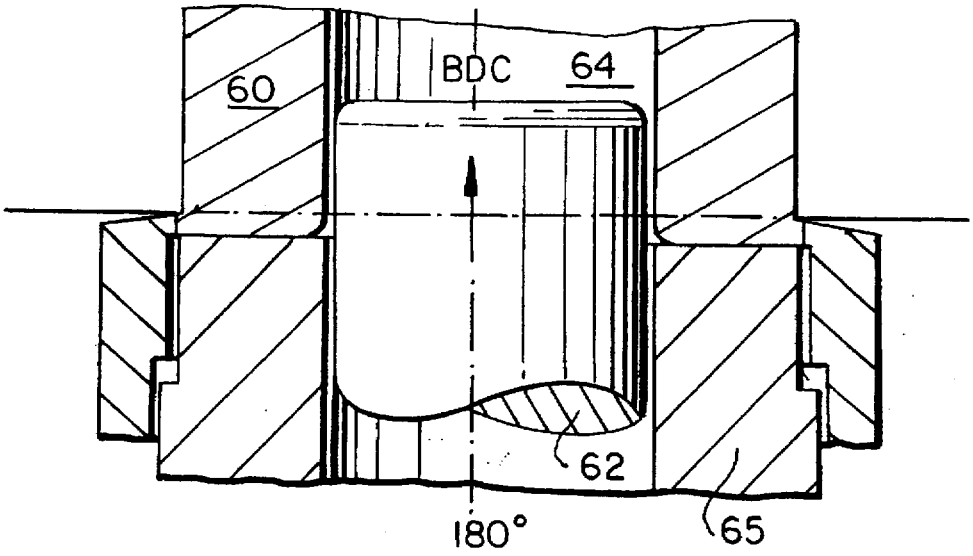

Referring to FIGS. 2, 3, and 4, the can stock fed into the press is clamped between planar clamping surface 61 of cupping die 60 and the planar surface 66 of clamping ring 65. The latter is coaxial with cupping punch 62. The cupping die 60 has a cutting edge 75 at its outer periphery. Cutting edge 75 coacts with fixed blanking tool 70; cutting edge 75 is located at travel plane 30 at the fabricating line. A circular blank is cut as part of the blanking action of FIG. 4. In FIG. 5, the can stock is clamped between the above-described planar surfaces.

Figure 6:
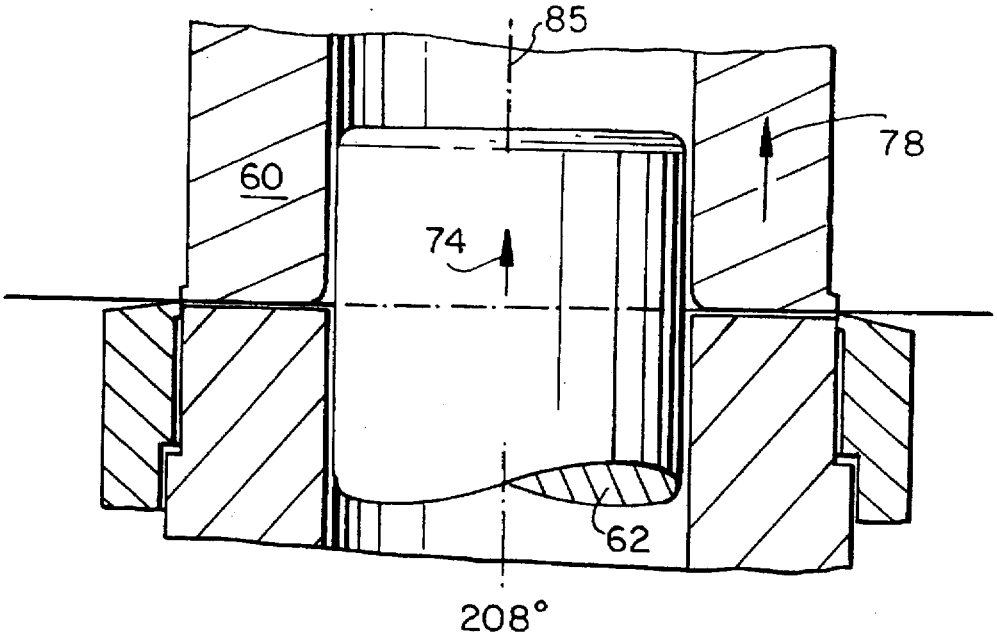

Shaping of the cup-shaped work product from flat-rolled can stock is commenced (after blanking) with simultaneous, coaxial, overlapping relative movement between punch 62 and die 60 as indicated by arrows 73, 74 in FIG. 4. As can stock is drawn into die cavity 64, the cupping die 60 reaches its bottom dead center (BDC), as shown in FIG. 5. In FIG. 6, punch and die are moved in the same direction with die 60 now moving in the upward direction shown by arrow 78, while both die and punch continue to move relative to each other in overlapping relationship.

Cupping die 60 and punch 62 move coaxially in relation to centrally-located axis 85 (FIG. 6); such axis is perpendicular to the geometric center of the cup-shaped work product endwall, as well as being centrally located in relation to the symmetrically located tooling of FIGS. 2–8). The crankshaft and connector arm means drive die 60 and punch 62 at selected value between about one hundred thirty-five and one hundred fifty degrees out-of-phase; the selected out-of-phase relationship having been maintained through the full cycle until cupping die 60 again reaches TDC. Note that the BDC status of punch 62 (FIG. 3) is 40° out-of-phase with the BDC of cupping die 60 (FIG. 5).

Such out-of-phase movement provides for differing rates of movement of the individual tools at differing cycle stages. Slower movement of the tooling, with increased force, takes place during the cup forming operation; and more rapid movement takes place after completion of cup formation for more rapid release of the cup and cup removal.

Figure 7:
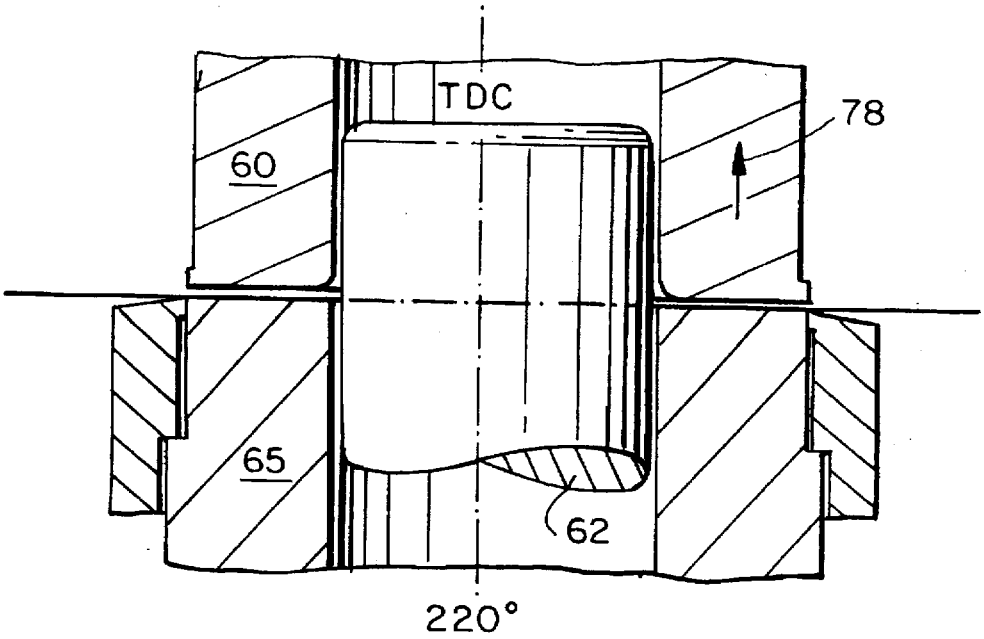

Die 60 moves slowly after cutting the blank in approaching its BDC (shown in FIG. 5) and in starting its upward movement, while punch 62 continues to move upwardly at a faster rate than die 60 as formation of the cup is being completed. Cupping is completed as punch 62 reaches its TDC at 220° into the 360° cycle (FIG. 7). As cup forming is completed, the tools move in opposite directions in relation to each other and release of the cup occurs rapidly. When both tools are free of the drawn cup, it is free to move from the press. Flat-rolled can stock has started to enter the press shortly before 293° into the cycle (FIG. 8); that is, shortly before the drawn cup is free to move from the press. During the time, from 293° into the cycle (FIG. 8) until slightly less that 147° into the next cycle, removal of the drawn cup is completed and introduction of can stock for the next cup is completed with the can stock in position for blanking. Such out-of-phase relationship during about half of the 360° cycle is shown by the apparatus in the several views of FIGS. 9–13.

Clamping ring 65 is pre-loaded for limited movement to allow for blanking, and to provide selected clamping force by pneumatic cylinders (available from Teledyne-Hyson Company, Dearborn, Mich.), or other preloaded spring-type structures can be used.

Incoming non-blanked can stock, or other means, can be used to start movement of the cup from the press as punch 62 reaches the position shown in FIG. 8; both cupping die and punch provide clearance for cup travel. The movement of the non-blanked sheet metal in the plane of travel plane 30 can be started shortly prior to the disposition shown in FIG. 8, since the flat can stock can be moved in its longitudinal direction a distance equal to the radial dimension of the initially-clamped metal (FIG. 4); that is, prior to full retraction of the punch 62 to the disposition shown in FIG. 8. Such movement of the can stock can be relied on to start movement of the work product from the cupping station onto travel path 30, or mechanically or magnetically activated means in the travel path can be used for cup movement toward the first redraw station.

FIGS. 9–13 schematically show rotational movement of crankshaft 56 by means of connector arm means 58 which move cupping die and cupping punch through the positions shown in FIGS. 2–8.

Figure 14:
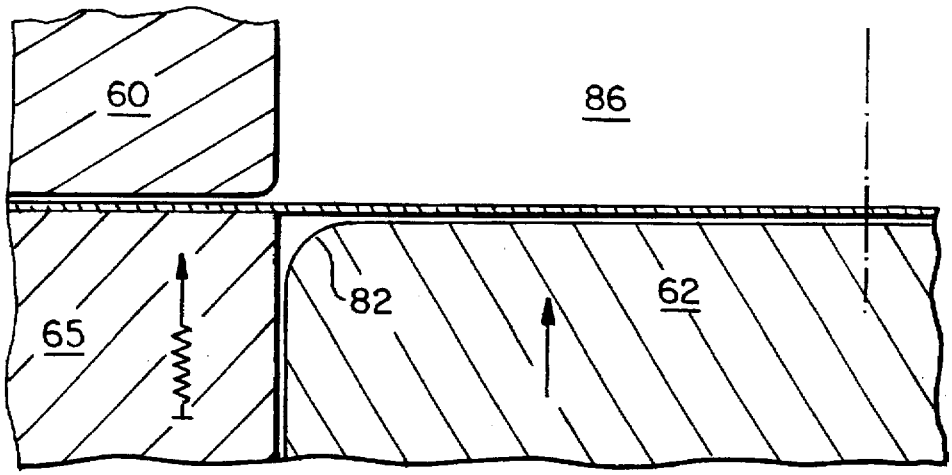

Portions of the cup forming tooling are shown in more detail in FIG. 14. Cup 40 is drawn symmetrically in relation to centrally-located axis, free of any increase in side wall thickness gage, by selection of tooling dimensions and configurations, preselected uniform peripheral clearance between punch and die, and by planar clamping.

Punch nose 82 is selected to have a surface area as projected on a horizontal plane which is perpendicularly transverse to the centrally-located axis, and measured radially, which is about forty times can stock thickness gage. Cavity entrance zone 86 is formed about multiple radii of curvature while maintaining a projection on the planar clamping surface which, measured radially, is about two to about five times can stock starting thickness gage. Use of multiple radii of curvature increases curved-surface area for start of movement of sheet metal into the cavity without increasing the projection of the entrance zone onto the clamping plane surface, while presenting a sharp edge for redrawing planar-oriented metal in multiple directions into a curvilinear side wall. In the specific embodiment, the multiple radii used for the cavity entrance zone 86 are about 0.05"/0.02"/0.05". The outer surface radius 0.05" provides for the gradual movement of can stock into and out of the transition zone, and mid-surface radius is about 0.02". The latter provides a sharper-edge configuration about which the can stock moves into the die cavity, which is an important aspect in achieving the uniformity of side wall gage; and the extent of gage reduction without breaking, tearing or cutting of sheet metal at such edges as metal is moved into a cylindrical configuration.

Note that sheet metal (0.02") is drawn under tension about such middle radius into the cavity which radius is about two times sheet metal gage for seventy-five lb/bb flat-rolled steel can stock; while initiation of entrance movement into the transition zone has a radius of about five to seven times that gage. The clearance between punch 62 and interior wall of cupping die 60 (around the full perimeter of each) is at least about the thickness of the coated can stock and can allow for tolerance specifications of the sheet metal. Also, cavity wall is slightly tapered internally to provide increasing diameter with increasing depth of penetration into such cavity.

In a later redraw stage of a two-step process, or two redraw stages, tooling clearance is selectively decreased between punch and cavity in relation to metal gage being drawn into the cavity which results in an increased side wall height under tension elongation. The tension on the metal being drawn into the cavity is uniform about its perimeter due to planar clamping and is gradually increased. The clearance at the die side wall (after the redraw die cavity entrance zone) is slightly less than the gage of can stock as it enters the cavity transition zone for tension elongation. Such elongation starts in the transition zone and is controlled by selection of the clearance at the full diameter of both punch and die. Tension-elongation of the sheet metal during the redraw is maximized about such small mid-radius sharp angle of a redraw cavity entrance zone. Planar clamping pressure is maintained throughout forming of a redrawn cup.

During redraw-processing of the invention, the uniform tooling clearance is selected around full side wall periphery to be equal to the gage of the can stock, not as introduced into the planar clamping area, but the gage of can stock as elongated about the cavity entrance transition zone for entry in a recessed internal side wall die cavity. The sheet metal is elongated under tension, free of ironing without being forged through a small diameter opening as used in side wall in ironing. The object in such redraw-processing, for a uniform redrawn side wall gage, is to set the clearances between redraw die and redraw punch less than the starting thickness gage for the coated can stock but equal to gage of the side wall as elongated through planar clamping and around the cavity entrance transition zone. For the redraw gage reduction, for example, in the specific embodiment with a starting gage of 0.0072" double-reduced steel, a clearance of about 0.007" (measured radially in cross section) is provided around the circumference in a redraw cupping die to provide tension elongation around the cavity entrance zone resulting in a side wall gage of about 0.0066"; the decreased gage is substantially uniform throughout side wall height between the closed endwall juncture and the open end flange. In a three-step operation, the clearance is also preselected in the successive diameter-decrease redraw operation to provide a uniform side wall gage of about 0.0055" for such embodiment; a uniform decrease in side wall gage of slightly more than twenty percent.

Figure 15:
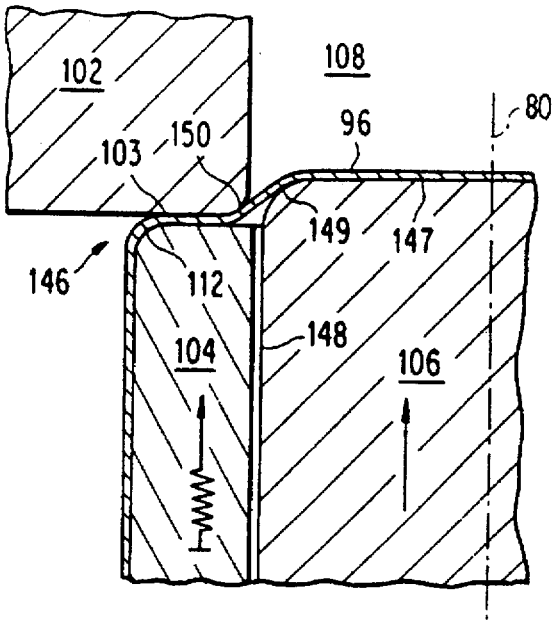
Figure 16:
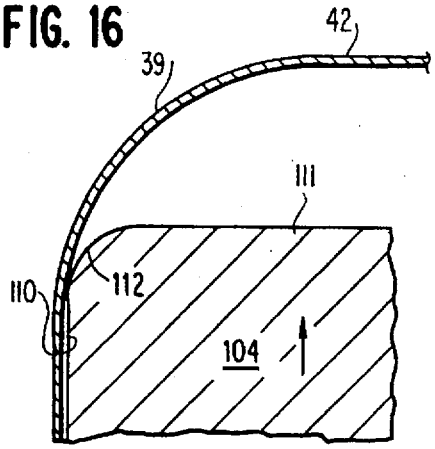
Figure 17:
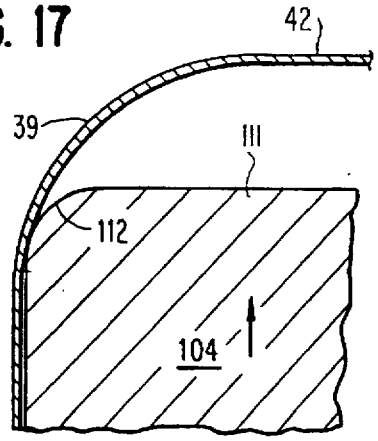
Figure 18:
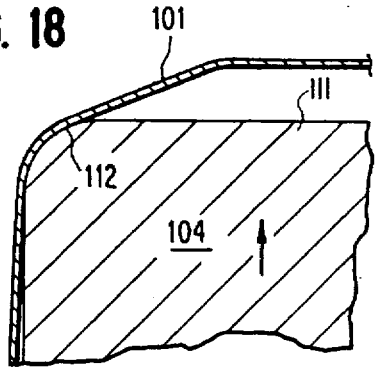
Figure 19:
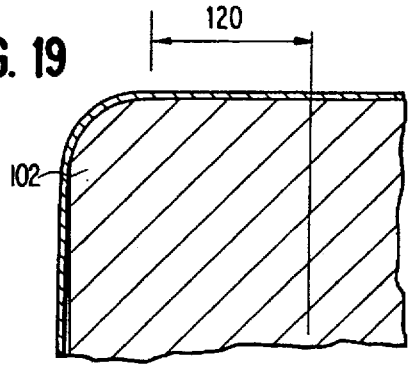

During the decrease in blank diameter of the cupping operation and subsequent decrease in cup diameter operation or operations, curved surface clampings or mating of any curved clamping surfaces, is eliminated; solely planar clamping provides uniform peripheral clamping and more accurate control of clamping pressure uniformly around the circumference. Redraw apparatus is shown in FIG. 15. However, the curved-surface cup juncture 39 between the closed endwall and side wall of the cup-shaped work product 37 is first reshaped about a smaller curved peripheral surface of the redraw clamping tool, as shown in FIGS. 16–18 and described in detail in copending application Ser. No. 07/866,661 which is incorporated herein by reference. The start of such juncture reshaping is carried out in a manner which creates a force on the closed endwall metal of the work product. That force is directed in a transverse plane in a direction away from the central longitudinal axis of the cup. The importance of such reshaping of the curved-surface work product juncture (as well as in the subsequent diameter-reduction redraw operation) is the same; reshaping such curved juncture, as taught, adds to the surface area of the can stock available solely for planar clamping between planar surfaces during formation of the new diameter can body. Fabrication of the multiple radii transition zone of the clamping ring of FIGS. 15 and 16–19 is shown in FIG. 20 and, also, is described in detail in such incorporated parent application.

FIG. 16 shows the juxtaposition of cup 42 with tooling approaching the closed endwall juncture 39 for such reshaping. Redraw die 102 (FIG. 15) presents solely planar clamping surface 103 and such planar clamping surface lies in a plane which is oriented to be transverse to central longitudinal axis 80.

When redrawn dies are made from sinter-hardened machineable material, such as tungsten carbide; and the clamping surface area is extended, as shown in FIG. 16, a taper is provided between the planar clamping surfaces. For example, surface 103 can be tapered (opening outwardly) a fraction of a degree (such as 0° 5') to facilitate movement of the can stock along such surface toward the cavity; for further details on use of taper with sinter-hardened tooling, see assignee's copending application Ser. No. 07/490,781 entitled DRAW-PROCESS METHODS, SYSTEMS AND TOOLING FOR FABRICATING ONE-PIECE CAN BODIES.

Axially-movable clamping tool 104 has a sleeve-like configuration and is disposed to circumscribe redraw punch 106. The redraw punch is adapted to move can stock into cavity 108 as defined by redraw die 102. The clearance between the internal wall of redraw cavity 108 and the peripheral wall of punch 106 is selectively decreased for each redraw in relation to the starting gage. Radial-clearance about the redraw punch is about 5% to about 15% less than substrate thickness, but is selected to be approximately equal to, or slightly greater than, the gage of the side wall as elongated about sharp-edge cavity entrance zone. Elongation of the can stock starts with movement of the large redraw punch as metal is drawn around a sharp-edge mid-radius of a cavity entrance zone. By decreasing clearance for tensile elongated metal to enter the die cavity above the transition zone, tension in the side wall substrate is increased. The substrate is stretched, decreasing in thickness by elongation under tension about the sharp edge of the cavity entrance zone as the curved punch nose radius enters the die cavity.

The result of that type of draw or redraw is a uniform decrease in side wall thickness gage along side wall height between juncture and flange of the redrawn can body. The redrawn side wall substrate gage is decreased about 10% to about 20% in the first redraw of FIG. 1. A combined side wall substrate thickness gage in the final and second redraws of FIG. 1 can be selected to provide a total gage reduction up to about twenty-five percent; total decrease can extend to about thirty-five percent; but the amount of decrease in side wall gage is dependent on starting gage and side wall requirements for sanitary can pack usage Referring to FIGS. 16–19, clamping sleeve 104 includes side wall 110, planar clamping endwall 111 and curved-surface transition zone 112 therebetween. The dimension of peripheral wall 110 of clamping sleeve 104 provides allowance for tool clearance (about 0.0025") in relation to the internal wall 38 internal side dimension of a work product cup 37.

The surface area of transition zone 112 of clamping sleeve 104 is significantly smaller than one-half the surface area of juncture 39 of cup 37; for example, about one fourth to about one-half. That is, in a specific embodiment, a projection of the transition zone 112 onto a clamping surface plane which is perpendicularly transverse to the central longitudinal axis occupies less than about 40% of the projection of cup juncture 101 on such plane. The interrelationship of these curved surfaces is selected to provide a difference of at least 60% in their radial projections on the transverse clamping plane. Juncture 39 of cup 37 is reshaped about transition zone 112 prior to otherwise starting metal movement into the die cavity due to movement of the redraw punch 106. Reshaping of the cup-shaped work product juncture is shown in FIGS. 12–15.

A smaller redraw die cavity entrance zone surface (described in more detail in relation to later figures) also increases the planar clamping surface area of the redraw die for coaction with the planar surface of the redrawn clamping ring. The redraw die cavity entrance radial projection is from about five to about 0.5 times substrate gage in the sequence of operations. Combining the effect of reshaping the cup juncture and use of a smaller cavity entrance zone projection increases the planar clamping surface available by a factor of at least two over that available for corresponding can body sizes using conventional draw-redraw tooling.

The redraw clamping sleeve peripheral transition zone (as viewed in cross section) is fabricated about multiple radii. As shown in FIG. 20, clamping sleeve 124 includes a planar endwall 126 which is transverse to the centerline axis of the cup; clamping sleeve 124 also includes a peripheral side wall 127. In preferred fabrication of the curved-surface transition zone for the clamping tool, a "large" radius R is used about center 128 to establish circular arc 129 which is tangent to the planar endwall surface 126. Extending circular arc 129 through 45° intersects with the extended plane of peripheral side wall 127 at imaginary point 130.

Using the radius R about center 132 establishes circular arc 134 tangent to side wall 127; extending arc 134 through 45° intersects the transverse clamping plane of endwall 126 at imaginary point 136.

Straight line 137 is drawn between imaginary point 136 and center 132; straight line 138 is drawn between imaginary point 130 and center 128; interrupted line 139 is drawn so as to be equidistant between parallel lines 137 and 138. Line 139 comprises the loci of points for the center of a "small" radius of curvature which will be tangent to both the circular arcs 129 and 134 so as to avoid an abrupt surface intersection at imaginary point 141. Using a radius of ½ R with its center 142 along line 139, circular arc 143 is drawn to complete a smooth, multiple radii curved surface for the transition zone of redraw clamping sleeve 124.

As a result of the clamping tool design of FIG. 16, the projection of the multiple radii curved surface on the transverse clamping plane of endwall 111 is 0.0707 times R, resulting in a further increase of almost 30% in the planar clamping surface over that available if a single radius R were used for the curved surface transition zone of redraw clamping sleeve 124. Also, a more gradual curved entrance surface 144 into the transition zone is provided; and a more gradual curved surface 145 from the transition zone onto the clamping surface 126 is provided. Curved surface 144 also provides for easier entrance of the redraw clamping ring transition zone into contact with the internal surface of the curved juncture of a cup-shaped work product for such juncture reshaping step.

In a specific cylindrical configuration embodiment for a multiple radii clamping sleeve transition zone for reshaping a 0.300" radius of curvature juncture for work product cup 76, R is selected to be 0.100"; therefore, the projection of clamping sleeve multiple radii transition zone on the transverse clamping plane comprises 0.0707", rounded off as 0.071". Other values for R can be selected; for example, a 1.25" radius of curvature for reshaping a cup juncture of substantially greater radius than 0.300"; or 0.9" for reshaping a smaller radius of curvature juncture; in general selecting R as 0.100" will provide desired results throughout the preferred commercial range of can sizes designated earlier.

As shown in cross section in FIG. 15, a funnel-shaped configuration 146 is established between planar surface 103 of die 102 and clamping sleeve transition zone 112 for movement of work product can stock into the axially transverse clamping plane without damage to the coating as male punch 106 moves into cavity 108. A further relief can be provided by having surface 103 diverge away from the clamping plane, as described earlier, at a location which is external (in a direction away from axis 80) of the planar clamping surface.

The can stock is stretched under tension by movement of the redraw punch of FIG. 15. Redraw punch 106 includes endwall 147, peripheral side wall 148 and curved surface transition zone 149 between such endwall and side wall. A large surface area is provided at transition zone 149 (the redraw punch nose) to the extent permitted by geometry requirements at the closed endwall juncture in later stages of the work product to facilitate starting each new diameter side wall. Coaction between such large surface area punch nose formed about a 0.20" radius of curvature for diameter reduction of the shallow-depth cup 37 in the specific example; also, a small projection cavity entrance zone surface is used, as described, preferably formed about multiple radii of curvature 0.050"/0.020"/0.050".

Referring to FIGS. 21–23 regarding such multiple radii cavity entrance zone, FIG. 21 is a vertical cross-sectional partial view of a cavity entrance zone for die 165 formed about a single radius of curvature 166, selected in accordance with earlier presented teachings at about five times sheet metal starting gage for the cupping stage; such radius decreasing in subsequent redraw operations. Single radius curved surface 168 for the entrance cavity is spaced from central longitudinal axis 80 and extends symmetrically between planar clamping surface 171 and internal side wall surface 172. Curved surface 168 is tangential (as viewed in such cross section) at each end of its 90° arc; that is, tangential to planar surface 171 and to the cavity internal surface 172, respectively.

In FIG. 22, such curved surface 168 (about single radius of curvature 166 of FIG. 22) is shown as an interrupted line; a 45° angle line 173, between the planar clamping surface and cavity side wall, is also shown by an interrupted line. Such 45° angle line 173 meets the respective points of tangency of single radius curved surface 168 with the planar clamping surface 171 at 174 and the internal side wall 172 at 175. The planar clamping surface 171 and the cavity internal surface 172 (as represented in cross section) would, if extended, define an included angle of 90°.

A larger surface area 176 (FIG. 22) for the entrance zone is provided by the present invention. The multiple radii cavity entrance zone concept is carried out, in the specific embodiment being described, by selecting a radius of about 0.050" as the "larger" radius (RL) for the multiple radii surface. Placement of such larger radii (RL, FIG. 23) surface provides for the more gradual movement of can stock from the planar clamping surface into the cavity entrance zone and, also, for the more gradual movement from the entrance zone into the interior side wall of the cavity. A smaller radius (Rs) for the specific embodiment, selected at about 0.020", is used to establish a curved surface which is intermediate, such larger radius (RL) portions located at the arcuate ends of the entrance zone surface. That is, the Rs surface is centrally located of such entrance zone. The interior cavity wall 172 is recessed slightly, about one-half degree to about 1°, in progressing from the curved surface entrance zone into the cavity.

A portion (178) of the curved surface 176 of FIG. 22 is formed in FIG. 23 about center 177 and uses the larger radius RL (0.050"); such surface portion 178 is tangential to the planar clamping surface 171 of the draw die. Such larger radius is used about center 180 to provide curvilinear surface 181 leading into the internal side wall of the cavity.

To derive the loci of points for the centrally located smaller radius (Rs) of curvature portion of the curved surface, the arcs of the larger radii surfaces 178, 181 are extended to establish an imaginary point 184 at their intersection. Connecting imaginary point 184 with midpoint 185 of an imaginary line 186 between the R centers 177, 180 provides the remaining point for establishing the loci of points (line 188) for the center of the smaller radius (Rs) of curvature; the latter will provide a curvilinear surface 190 which is tangential to both larger radius (RL) curvilinear surfaces 178 and 181. In the specific embodiment for a twelve ounce beverage can body, the larger radius (RL) of curvature is selected at about 0.05" (in a range of 0.040" to 0.060") and the smaller radius (Rs) of curvature is selected at about 0.02" (in the range of 0.015" to 0.025"). A specific example for the cupping cavity entrance zone is 0.025"/0.010"/0.025".

In such multiple radii configurations, the smaller radius (Rs) curved surface is located intermediate the two larger (RL) surfaces, e.g. 0.05"/0.02"/0.05", and provides the edge about which the can stock is tensioned as the side wall is stretched for movement into the preselected clearance between the punch diameter and the start of the die cavity internal wall.

In order to provide a 1° recessed taper (FIG. 23) for the die cavity internal surface, the arc between the planar clamping surface and such internal surface is increased by 1°; such 1° arc increase being added at the internal surface end of the arc. Such added 1° of arc enables such internal surface to be tangent to the curved surface at point 191; that is, 1° beyond the 90° point of tangency (175). A tangential recess-tapered internal side wall cannot be provided without such added arc provision as described immediately above. The location of a 1° taper internal side wall surface, is shown at line 192 in relation to a non-tapered side wall surface indicated by line 172, such taper measured in a vertically-oriented plane when a can body is formed in an upright position.

Endwall profiling is carried out in the final redraw in either two-step or three-step processing, with endwall profiling tooling, as shown in FIGS. 24–25. The bottom wall 220 of the redrawn work product is reshaped using closed endwall profile tooling. As shown in FIG. 24, reshaping of the curved juncture of the previous cup has been completed and the metal which is peripheral to upwardly moving redraw punch 212 is being clamped solely between the planar clamping surface 213 of draw die 214 and upper planar surface 216 of clamping tool 217, free of curved nesting surfaces. A new diameter is being redrawn about the peripheral portion 218 of final redraw punch 212 so that endwall 220 is planar during this phase of the draw-processing.

Male profile member 226 is fixed, so that coaction between its profiling surface 228 and the recessed profiling surface of draw punch 212 is started as redraw is being completed. As shown in FIG. 25, clamping action has been released on flange 222 as draw die 214 moves upwardly. As clamping action is released, final redraw punch 212 approaches and reaches the top of its upward stroke to bring about countersinking of the endwall 22 (FIG. 24) to form the profiled endwall. The prior release of clamping action on the flange avoids damage to the sheet metal due to such movement. Final redraw punch 212 is withdrawn downwardly upon completion of endwall profiling. Such endwall profiling is described in copending application Ser. No. 07/866,661 which is incorporated herein by reference.

Flat-rolled sheet metal for the can body application taught by the present invention can comprise flat-rolled steel from about thirty-six lb/bb to about eighty-five lb/bb in which thickness tolerances are generally within 10%; and nominal flat-rolled aluminum thickness gages are above about 0.005" to about 0.015".

The preferred substrate surface for flat-rolled steel for adhesion of organic coating is a "TFS" (tin-free steel) coating which comprises an electrolytic plating of chrome and chrome oxide. However, with the present invention, deep drawing of flat-rolled steel with other substrate surfaces for later protective organic coating, such as chrome oxide from a bath or cathodic dichromate (CDC) treatment, or as disclosed in copending application Ser. No. 07/926,055 entitled COMPOSITE-COATED FLAT-ROLLED SHEET METAL MANUFACTURE AND PRODUCT, filed Aug. 6, 1992 can also be utilized to augment surface adhesion of outer surface coating. Organic coating and draw lubricant coating are selected for each surface to provide for draw requirements on each such surface as well as container content requirements on the product side surface. That is, the types of organic coating and blooming compound draw lubricant are selected for a particular surface of the can stock. An organic coating weight for the "public" surface in the range of about two and one-half milligrams per square inch (2.5 mg/sq. in.) to about ten mg/sq. in. is preferred on the "product side." Thermosetting organic coatings are preferably selected from epoxies, vinyls, organosols, acrylics, polyesters and films such as polyurethane, polypropelene, polyethylene and poly alkaline terephthaltes for use with containers for comestibles. The ability to manufacture draw-processed can bodies, including can bodies in which side wall height exceeds diameter, without damage to precoated organic polymeric coatings is an important contribution of the invention. A wide and increasing range of organic polymer coatings is finding use in canmaking. The organic coating is designated to withstand deep drawing as die wall metal is drawn, under tension, so as to avoid any significant increase in thickness gage along the side wall height. The organic coatings are selected so as to be capable of being applied with appropriate "blooming compound" draw lubricant, to meet particular surface requirements. The higher organic coating weight on the product side is utilized to assure product protection; the lubricant requirement on the product side surface is less than on the exterior.

Suitable organic coatings with blooming compound for carrying out draw processing objectives of the invention are made available based on the product and can body size requirements through such coating manufacturers as The Valspar Corporation, 2000 Westhall Street, Pittsburgh, Pa. 15233, The Dexter Corporation, East Water Street, Waukegan, Ill. 60085, or BASF Corporation of Clifton, N.J. Any surface-applied draw lubricant required is added upon curing of the organic coating, with total draw lubricant (blooming compound and surface-applied) per side being selected in the range of about ten to about twenty mg per square foot per side. Surface lubrication is preferably carried out after curing of the organic coating by coil coaters such as Precoat Finish of St. Louis, Mo., or PMP of McKeesport, Pa. to enable demand oriented operation of the can body fabricating line, independent of surface preparation, as described earlier. Such desired draw lubricant coating weights on each surface are verified before entry of can stock into the fabricating process. With present teachings, the integrity of the precoated organic coating is maintained such that neither post-fabrication interior surface coating nor coating added for repair purposes is required for can bodies for sanitary can packs.

Data on a specific embodiment of a two-step and three-step process, with comparison to conventional draw-redraw process is set forth below:

TABLE I

| | Two-Step Process Can Body for 307 × 110.5 602 Pet Food Can (In Inches) | | | | |
|---|---|---|---|---|---|
| Process | Blank Diameter | Cup Dia.\| Hgt. | Redrawn Can Body Dia.\| Hgt. | Flat-Rolled Steel bb per 1000 Can Bodies | Metal Saving |
| Conv. Draw Redraw | 5.96 | 4.11\| 1.13 | 3.29\| 1.73 | 1.012 | Base |
| 2-Step (1 Redraw) Side Wall Gage Decrease 20% | 5.73 | 3.54\| 1.44 | 3.29\| 1.73 | .935 | 7.6% |

TABLE I-continued

| | Three-Step Process Can Body for 211 × 315 10-3/4 oz. Soup Can (In Inches) | | | | | |
|---|---|---|---|---|---|---|
| Process | Blank Diameter | Cup Dia.\| Hgt. | 1st Redraw Dia.\| Hgt. | 2nd Redraw Dia.\| Hgt. | bb/ 1000 Can Bodies | Metal Saving |
| Conv. Draw Redraw | 7.00 | 4.02\| 2.04 | 3.14\| 3.13 | 2.57\| 4.01 | 1.40 | Base |
| 3-Step Side Wall Gage Decrease 18% | 6.68 | 3.81\| 1.93 | 2.86\| 3.13 | 2.57\| 4.01 | 1.25 | 10.8% |
| 3-Step Side Wall Gage Decrease 20% | 6.57 | 3.81\| 1,88 | 2.86\| 3.06 | 2.57\| 4.01 | 1.23 | 12.5% |

While specific can body and can sizes, tooling dimensions, sheet metal materials and coating specifications have been set forth in describing the invention, those skilled in the art will recognize that modifications to such specific data and information can be utilized in light of the above teachings. Therefore, for purposes of determining the scope of the present invention, reference shall be had to the appended claims.

We claim:

1. Apparatus for draw-processing, free of sidewall ironing, precoated sheet metal can stock into a precoated one-piece cylindrical-configuration cup-shaped work product, comprising, in combination, means for supplying circular-configuration cut blanks of precoated planar can stock consisting essentially of flat-rolled sheet metal substrate of preselected starting thickness gauge which has been prepared for and precoated on both planar surfaces of the substrate with a surface coating, including an organic polymeric coating and draw-processing lubricant for each such can stock surface, cupping press means, including draw-forming tooling means, which move coaxially in relation to a centrally-located axis to provide for draw-forming the precoated cut blank, free of sidewall ironing, to form a one-piece cup-shaped work product, the one-piece cup-shaped work product including a centrally-located axis which coincides with the centrally-located axis of the tooling during fabrication of such work product, a substantially-planar closed endwall of circular configuration in plan view disposed such that the centrally-located axis intersects the circular configuration endwall in perpendicular relationship to the geometric center of such endwall, a cylindrical-configuration sidewall, which is symmetrically disposed with respect to and uniformly spaced from the centrally-located axis, defining an open end for the cup-shaped work product, a unitary juncture between the planar endwall and cylindrical sidewall, the unitary juncture having a curved configuration as viewed in cross section in a plane which is defined by including the centrally-located axis, and a can body flange extending around substantially the full perimeter at the open end of the cup-shaped work product as drawn, the flange being oriented radially-outwardly in a plane which is in substantially perpendicular transverse relationship to the centrally-located axis so as to provide a uniform sidewall height between such open end flange and the unitary juncture of the cup-shaped work product, with substrate of the closed endwall, between its geometric center and the unitary juncture, having a thickness gauge substantially equal to the preselected starting gauge for the flat-rolled sheet metal substrate as supplied, and sidewall substrate which is free of an increase in thickness gauge above such preselected starting gauge throughout the height of the sidewall from a location contiguous to the unitary juncture to a location contiguous to the flange at the open end of the cup-shaped work product;

the draw-forming tooling means, including (a) a cupping die presenting:

(i) an internal wall defining a die cavity having a circular configuration in a plane which is perpendicularly transverse to the centrally-located axis, (ii) a curved surface, as viewed in cross section in a plane which is defined by including such centrally-located axis, defining an entrance zone into such die cavity, the cupping die cavity entrance zone presenting a curvilinear configuration surface about which such coated substrate is drawn into such cavity, such cupping die entrance zone, as projected onto a plane which is perpendicularly-transverse to such centrally-located axis, having a radial dimension within a range which exceeds such predetermined starting thickness gauge but is less than about five times such starting gauge, and (iii) a planar clamping surface in substantially perpendicular transverse relationship to such centrally-located axis circumscribing the cavity entrance zone;

(b) a cupping punch presenting:

(i) an endwall for forming an endwall for such work product, such work product endwall having a substantially-planar configuration portion disposed in substantially perpendicular transverse relationship to such centrally-located axis, (ii) a cylindrical sidewall, symmetrically-disposed with relation to such centrally-located axis, and (iii) a unitary juncture, extending between such punch endwall and punch sidewall, having a curvilinear configuration surface as viewed in cross section in a plane which includes such centrally-located axis, such unitary juncture curvilinear-configuration surface, as projected onto such perpendicularly-transverse plane, having a radial dimension in a range of about twenty-five times to about forty times such substrate starting thickness gauge, the cupping punch being disposed for coaxial relative movement into, and from, the cupping die cavity; and (c) a clamping element circumscribing the cupping punch, the clamping element presenting:

(i) a planar clamping surface in substantially perpendicular transverse relationship to such centrally-located axis for coacting with the planar clamping surface of the cupping die for clamping pre-coated planar can stock between such planar clamping surfaces, and (ii) an interior sidewall of cylindrical-configuration circumscribing the cupping punch.

2. The apparatus of claim 1 for forming flat-rolled steel substrate having a thickness gauge in a range above 35 pounds per base box to about 90 pounds per base box, in which the cupping die cavity entrance zone, as projected onto a plane which is perpendicularly transverse to such centrally-located axis, has a radial dimension in the range of about 0.02" to about 0.05".

3. The apparatus of claim 1 for forming flat-rolled steel substrate having a thickness gauge in a range of about 35 pounds per base box to about 90 pounds per base box, in which such cupping die cavity entrance zone is formed about multiple radii of curvature in which, a curvilinear surface for entering such zone from the cupping die planar clamping surface is formed about a radius of about 0.05", the surface for leaving such zone for entry into the internal wall defining the die cavity is formed about a radius of about 0.05", and the remaining curvilinear surface, as located therebetween, is formed about a radius of about 0.01" to about 0.02".

4. The apparatus of claim 3, in which the internal wall of such die cavity has a taper of about one degree as viewed in a plane which is defined by including the centrally-located axis, with such taper increasing the diameter of such internal wall with increasing penetration of such die cavity.

* * * * *